United States Patent [19]

Harrison et al.

[11] 4,236,956

[45] Dec. 2, 1980

[54] FLOOR LAYING TOOL

[76] Inventors: Donald A. Harrison, P.O. Box 3214, Tequesta; Howard A. Lanier, 1002 Hawie St., Jupiter, both of Fla. 33458

[21] Appl. No.: 968,078

[22] Filed: Dec. 11, 1978

[51] Int. Cl.[3] ..... B44C 7/06

[52] U.S. Cl. ..... 156/527; 15/105; 156/574; 156/579

[58] Field of Search ..... 156/574, 523, 527, 579, 156/475, 536, 575, 577, 468; 15/105, 105.5, 235.4, 235.5, 235.7, 245

[56] References Cited

U.S. PATENT DOCUMENTS

| | | | |
|---|---|---|---|
| 1,628,243 | 5/1927 | Hagen | 15/245 |
| 1,647,751 | 11/1927 | Schacht | 15/245 |
| 2,630,591 | 3/1953 | Smith | 15/105 |
| 2,770,879 | 11/1956 | Seymour | 156/523 |
| 2,800,013 | 7/1957 | Cesar | 15/235.4 |
| 3,188,262 | 6/1965 | Torrison | 156/575 |
| 3,273,191 | 9/1966 | Chambers | 15/105 |
| 3,674,610 | 7/1972 | Bennett | 156/579 |

*Primary Examiner*—Michael G. Wityshyn
*Attorney, Agent, or Firm*—Eugene F. Malin; Barry L. Haley; Philip R. Wadsworth

[57] ABSTRACT

A floor laying tool utilized in installing synthetic floor materials such as vinyl sheet flooring adjacent walls. This floor laying tool is used to lay vinyl type flooring materials on a subfloor. The tool includes a handle, a downwardly projecting shaft connected to one end of the handle, and a working plate portion. The lower end of the downwardly projecting shaft is connected to the top of the tool's working plate portion. The tool's working plate portion is generally in the shape of a triangle with rounded corners. The first corner is connected to the downwardly projecting end of the shaft with the other two corners positioned equidistant from the first corner. The plate portion and rounded corners are utilized to bond the vinyl to the subfloor along the edges of a baseboard.

3 Claims, 3 Drawing Figures

FLOOR LAYING TOOL

BACKGROUND OF THE INVENTION

This invention relates to a specially shaped tool used to install vinyl along a baseboard. The triangular shaped working plate portion insures bonding between the subfloor and the edge portion of the vinyl flooring.

In the past, after the vinyl was initially laid on the floor with an excess of material extending up the wall of baseboard, the installer would use a knife to trim the material from the baseboard. In order to avoid over cutting the vinyl, the installer would normally make a plurality of cuts of smaller and smaller width until the vinyl moves off the baseboard and lies flat on the subfloor. The exact line of a perfect cut is hard to determine because of the curved vinyl bridging the corner between the floor and the baseboard. Therefore, a plurality of trimming cuts were necessary until the edge of the vinyl flooring moves downwardly past the baseboard. This procedure is slow, costly and time consuming. The installer also had to use a plurality of tools to cut and press the vinyl into engagement with the glue on the subfloor adjacent the baseboard.

BRIEF DESCRIPTION OF THE INVENTION

This invention relates to a floor laying tool for laying both soft and hard vinyl adjacent a baseboard. The tool includes a handle, a shaft, and a generally triangular-shaped flat tool portion. One end of the handle is connected to the shaft. One portion of the shaft is held within the handle. The other portion of the shaft projects downwardly at an angle generally greater than 90 degrees from the longitudinal axis of the handle. The distal end of the shaft is connected to the top of the tool's working plate portion adjacent a first angle. The plate portion is preferably in the shape of a triangle with the distal side edge of the triangle positioned perpendicular to the longitudinal axis of the handle. The triangle preferably includes a front large angle and two smaller angles of equal angularity. The distal end of the shaft is connected to the plate portion at or adjacent to the first angle.

The longitudinal center line of the downwardly projecting portion of the shaft is generally positioned perpendicular to the plate portion, that is, the plane of the tool's working plate portion. The two smaller angles have rounded corners without sharp edges that are used to push the vinyl down into the corner between the baseboard and the subflooring. This action creases the vinyl. This provides an accurate cut line on top of the vinyl. The tool provides a means to position the vinyl in a corner between a baseboard and the subfloor. The dulled, rounded edges are required to prevent cutting the vinyl permanently before it is positioned in the corners.

The flat bottom of the plate portion of the tool is used to press the vinyl against the subfloor. Glue is placed between the vinyl and the subfloor for permanent bonding. The main lower surface or larger lower area of the plate portion is used to apply pressure to an area of the vinyl and make it lay flat against the subfloor.

The two equal lengthed sides of the tool surface are used as relief means in order to allow the tool to reach into the corners between two walls and the subfloor, door jams, pockets, and subfloors. Thereafter, a separate knife may be utilized along the cut line to cut away the excess vinyl. The knife blade is moved along the cut line left by the corners of the tool. The longest edge or front edge of the tool's working plate portion may be sharp. The sharpened front edge may be used to cut the vinyl by moving the front edge along the cut line or crease to cut the vinyl for perfect positioning of the edge of the vinyl against the baseboard.

It is an object of this invention to provide a vinyl tool that may be utilized to lay vinyl in corners adjacent a baseboard or two walls and a subfloor.

It is another object of this invention to provide a non-complex tool for creasing the vinyl into corners and for pressing the vinyl against the floor adjacent a corner and for marking a cutting line on the upper surface of the vinyl.

A further object of this invention is to have a corner vinyl tool that also may be used to trim the vinyl flooring.

In accordance with these and other objects which will be apparent hereinafter, the instant invention will now be described with particular reference to the accompanying drawings.

DESCRIPTION OF THE PREFERRED EMBODIMENT OF THE INVENTION

Figure 1:
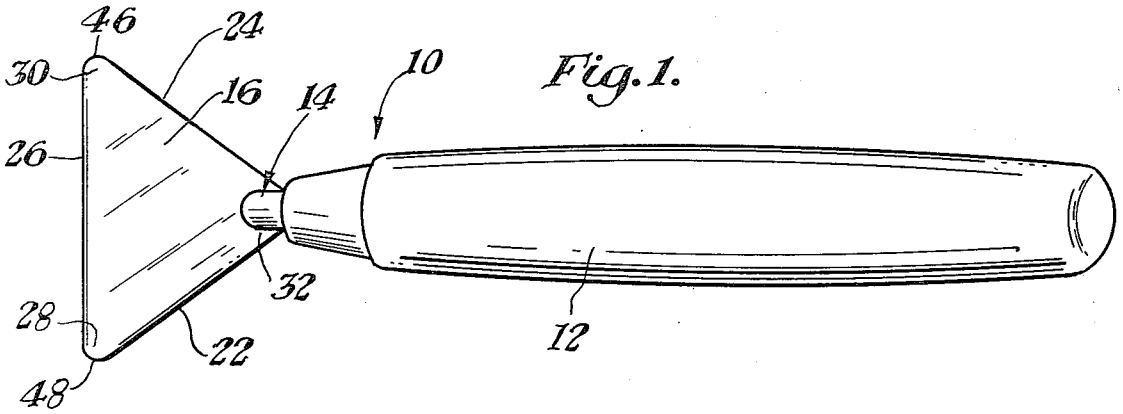
FIG. 1 is a top view of the tool.
Figure 2:
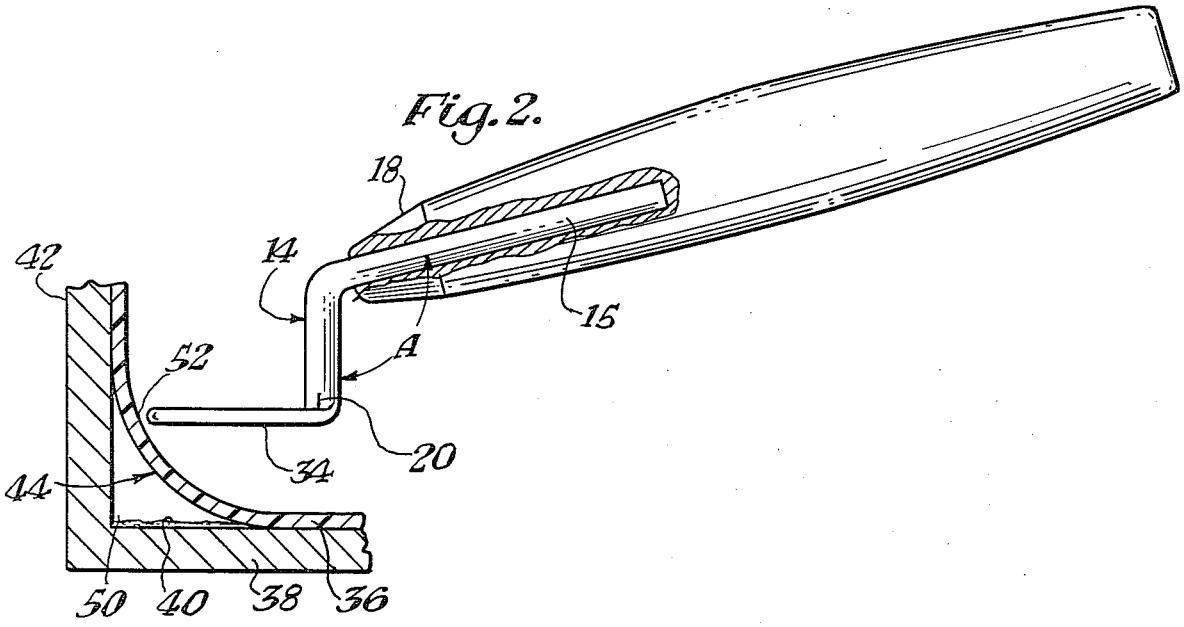
FIG. 2 is a side view of the tool shown in FIG. 1 also illustrating a baseboard, subfloor, and a vinyl sheet in a bridging position.
Figure 3:
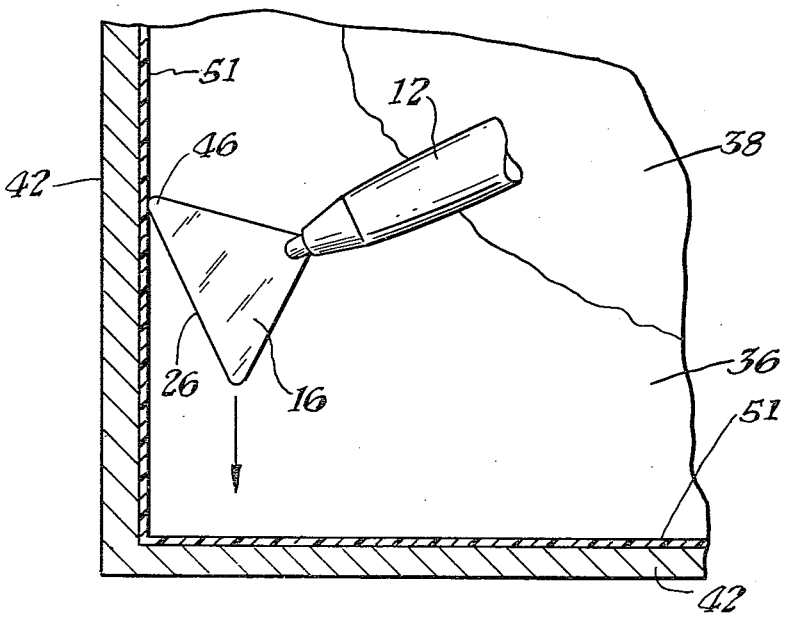
FIG. 3 is a plan view of an illustration of the tool shown in FIG. 1 showing the vinyl material placed in the corner of a room with a portion of the vinyl laying up the wall after it is forced into the corner between the baseboard and the floor.

Referring now to the drawing, FIGS. 1 through 3, illustrating the invention and the tool use, the tool is generally referred to by numeral 10. Tool 10 includes a handle 12 with a connecting shaft 14, and a tool working plate portion 16. The handle is used by a user to grip the tool. The shaft 14 includes a first portion 15 that is positioned in the handle 12. The handle 12 and the shaft portion 15 have a common longitudinal center line. The shaft includes a second portion 20. The angle between the center line of the tool handle 12 and the center line of the second portion of the shaft is greater than 90 degrees as illustrated by the letter A in FIG. 2. The second portion 20 of the shaft projects downwardly from one end of the handle designated by numeral 18. The lower end of the shaft 14 is connected to the top of the tool's working plate portion 16. The tool's working plate portion 16 includes two equal side edges 22 and 24 with a longer side edge 26 having two equal angles 28 and 30 and a larger angle adjacent numeral 32. The bottom surface 34 maybe utilized to press the vinyl 36 against the subfloor 38 with the intermediate glue 40 therebetween.

As shown in FIG. 2, when the vinyl is first placed on the floor 38 the excess material will normally lay against the baseboard 42 with an intermediate area spaced from the corner 50 as shown at 44. The round dull radius edges or corners of the tool's working plate portion 16 illustrated at 46 and 48 in FIG. 1 may be utilized to press the vinyl as illustrated in FIG. 2 into the corner 50 to the position illustrated in FIG. 3. When the vinyl is pressed into the corner 50, a definite line will appear on the upper surface of the vinyl adjacent numberal 52, such as illustrated at 51 in FIG. 3. This line will be the proper cutting line to position the vinyl properly on the floor against the baseboards.

The vinyl may be cut by a separate knife or the front edge 26 of the tool may be sharp to knife edge, not shown, to cut the vinyl.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A tool for laying vinyl, comprising:

a handle with a longitudinal center line, a shaft connected to the handle including a first portion connected to the handle and a second portion projecting away from the longitudinal center line of said handle, said second portion having a distal end spaced from the longitudinal center line of said handle, a flat, generally triangular-shaped plate connected to said distal end of said second portion of said shaft, said triangular-shaped plate having at least two rounded corners, said plate having a forward distal straight edge transversely positioned with respect to the longitudinal center line of said handle, said straight edge having a rounded corner of said triangular-shaped plate at each end, said triangular-shaped plate having a third corner, said triangular-shaped plate connected to said distal end of said second portion of said shaft adjacent said third corner, said two rounded corners having dull edges to crease the vinyl flooring into corners between a baseboard and a subflooring without cutting the vinyl flooring, said triangular-shaped plate having a lower flat surface area for pressing of the vinyl against the subfloor, and said triangular-shaped plate positioned at an angle to said handle with the phantom extension of said longitudinal center line of said handle and the plane of the plate intersecting.

2. A tool for laying vinyl, comprising:

a handle with a longitudinal center line, a shaft connected to the handle including a first portion connected to the handle and a second portion projecting away from the longitudinal center line of said handle, said second portion having a distal end spaced from the longitudinal center line of said handle, a flat, generally triangular-shaped plate connected to said distal end of said second portion of said shaft, said triangular-shaped plate having at least two rounded corners, said plate having a forward distal straight edge transversely positioned with respect to the longitudinal centerline of said handle, said straight edge having a rounded corner of said triangular-shaped plate at each end, said triangular-shaped plate having a third corner, said triangular-shaped plate connected to said distal end of said second portion of said shaft adjacent said third corner, said two rounded corners having dull edges to crease the vinyl flooring into corners between a baseboard and a subflooring without cutting the vinyl flooring, said straight edge having a sharp cutting edge, said triangular-shaped plate having a lower flat surface area for pressing of the vinyl against the subfloor, and said triangular-shaped plate positioned at an angle to said handle with the phantom extension of said longitudinal center line of said handle and the plane of the plate intersecting.

3. A tool as set forth in claim 1, wherein: said straight edge is positioned a short distance from said distal end of said second portion from said distal end of said second portion of said shaft.

* * * * *